United States Patent [19]

Psaar et al.

[11] Patent Number: 4,918,048

[45] Date of Patent: Apr. 17, 1990

[54] THERMOREACTIVE RECORDING MATERIAL

[75] Inventors: Hubertus Psaar, Leverkusen; Siegfried Korte, Odenthal, both of Fed. Rep. of Germany

[73] Assignee: Bayer Aktiengesellschaft, Leverkusen, Fed. Rep. of Germany

[21] Appl. No.: 186,329

[22] Filed: Apr. 26, 1988

[30] Foreign Application Priority Data

May 12, 1987 [DE] Fed. Rep. of Germany ..... 3715724

[51] Int. Cl.[4] ..... B41M 5/18

[52] U.S. Cl. ..... 503/216; 427/150; 427/151; 503/217; 503/225

[58] Field of Search ..... 427/150–152; 503/216, 217, 225, 221, 224

[56] References Cited

U.S. PATENT DOCUMENTS 4,590,500 5/1986 Satake et al. ..... 503/216

4,600,930 7/1986 Psaar ..... 503/201

*Primary Examiner*—Bruce H. Hess

*Attorney, Agent, or Firm*—Sprung Horn Kramer & Woods

[57] ABSTRACT

A thermoreactive recording material contains a dyestuff precursor and an acid-modified polymer of acrylonitrile or methacrylonitrile and a 4-hydroxybenzoic acid ester as acceptor.

8 Claims, No Drawings

THERMOREACTIVE RECORDING MATERIAL

The invention relates to a thermoreactive recording material which contains a dyestuff precursor and an acid-modified polymer of acrylonitrile or methacrylonitrile and a 4-hydroxybenzoic acid ester as acceptor.

Heat-sensitive recording materials in which a colourless dyestuff precursor and an acceptor are applied in one layer to a carrier material, the two components being encased separately in other materials in order to prevent a premature colour reaction, are already known. During heat treatment, the two components are brought into contact by melting of the casings and, if appropriate, of the acceptor material and a colour reaction is initiated. Dyestuff precursors from various classes of dyestuff are known as colour-forming agents. The materials hitherto chiefly disclosed for initiation of the colour reaction and organic compounds containing phenolic groups.

US-A-4,600,930 describes a process in which acid-modified polyacrylonitrile is used as acceptor. These materials indeed act as very good developers with dyestuff precursors of relatively low molecular weight. With large molecules, however, the intensity of the colour formation decreases markedly, especially in high-speed printing.

It has now been found that the activity of the poly(-meth)acrylonitrile developer can be increased, without the advantages of this developer such as increased stability towards external influences, e.g. by moisture or plasticizer, being lost, by adding one or more 4-hydroxybenzoic acid esters.

In principle, all polymers of acrylonitrile and methacrylonitrile which contain acid groups capable of developing the dyestuff precursors and are distinguished by a high affinity for the dyestuffs released are suitable. This latter property leads to binding and stabilizing of the colouring components.

Possible polymers are homopolymers and copolymers of acrylonitrile and methacrylonitrile with other vinyl compounds, these copolymers containing at least 60 mol % of (meth)acrylonitrile units. The glass transition temperature of the polymers can be varied within wide ranges and adapted to suit the desired effect by using certain comonomers.

Examples of suitable comonomers are: vinylidene cyanide, vinyl fluoride, vinylpyridine, vinylimidazole, vinylpyrrolidone, alkyl acrylates and methacrylates and acrylamides and methacrylamides, vinyl carboxylates, olefinically unsaturated mono- and dicarboxylic acids, olefinically unsaturated sulphonic acids and alkylbenzenesulphonic acids and salts and esters thereof.

The polymers contain—if appropriate in latent form—strongly acid groups, preferably sulphonate and sulphate groups, salts and esters thereof, and/or weakly acid groups, preferably carboxyl groups and salts thereof.

The acid groups are either introduced into the end of the polymer chain by an acid catalyst, or are introduced by comonomers containing acid groups or latent forms thereof. The acid groups in latent form, in particular the esters, can be hydrolyzed in the course of the preparation of the polymers or during later processing and use.

The total acid content of the polymers, that is the content of free acid groups and acid groups in latent form, is at least 50 m equivalents/kg. Polymers with an acid content of at least 200 m equivalents/kg are preferred.

The acid-modified polymers are prepared by known methods. These are described, for example, in DE-C-654,989, US-A-2,601,256 and US-A-2,913,438, and in F. Krcil "Kurzes Handbuch der Polymerisationstechnik (short Handbook of Polymerization Techniques)" (1940) Vol. I, page 722–725, and in Houben-Weyl, "Methoden der organischen Chemie (Methods of Organic Chemistry)" (1961), Vol. XIV/1 pages 998 to 1,009.

Acrylonitrile polymers which, in addition to weakly acid groupings, have strongly acid groups partly in latent form have proved to be particularly suitable.

Such acrylonitrile polymers are accessible in a simple manner by precipitation polymerization in aqueous media. Acrylonitrile and the comonomer components, in particular the olefinically unsaturated carboxylic acids and the compound containing sulphonic acid ester groups, are thereby reacted with high yields. It is an advantage that this procedure gives the polymers in fine-divided particle form, that is with a particle size and structure which is particularly favorable for their use. Subsequent process steps, for example coagulation, grinding or sieving processes, for establishing the required particle size can thus be dispensed with. The polymers obtained in powder form preferably have particle sizes of $<200$ μm, in particular 5–100 μm.

Preferred polymers are obtained by polymerization of 60–95, in particular 70–90, mol % of acrylonitrile and/or methacrylonitrile, 4–25 mol % of (cyclo)alkyl acrylates and/or methacrylates and/or vinyl carboxylates, 0.5–10, in particular 1.5–7, mol % of olefinically unsaturated carboxylic acids and 0.5–10, in particular 0.5–3, mol % of comonomers containing sulphonate groups.

The total content of acid groups in the preferred polymer is at least 200, preferably at least 400, m equivalents/kg of polymer. The content of weakly acid groups, such as carboxylic acid groups, is at least 20, preferably at least 30% of the total content of acid groups.

The solution viscosity $\mu_{rel}$ (0.5% in dimethylformamide) is preferably 1.0–6.0. This corresponds to K values of 10–150.

The following comonomers are to be mentioned in particular:

as (cyclo)alkyl acrylates and methacrylates—those which are derived from a $C_1$–$C_{18}$-alkyl alcohol or cyclohexanol, such as butyl acrylate, (ethyl)-hexyl acrylate and cyclohexyl acrylate;

as vinyl carboxylates—aliphatic $C_1$–$C_{17}$-alkyl carboxylates, such as vinyl acetate and vinyl stearate;

as olefinically unsaturated carboxylic acids—mono- and dicarboxylic acids with a $C_2$–$C_{17}$-alkenylene radical, such as acrylic, methacrylic, itaconic and maleic acid;

as compounds containing sulphonate groups—those of the formulae

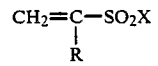

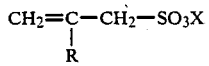

-continued

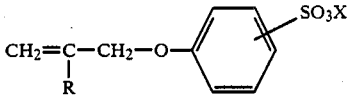

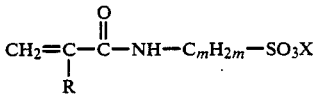

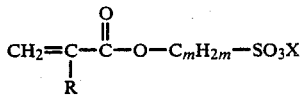

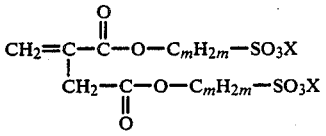

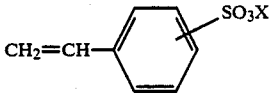

R=H or $CH_3$.

X=optionally alkoxylated $C_1$–$C_4$-alkyl, preferably methyl, ethyl, $(-C_2H_4-O-)_nH$ or $(-C_3H_6-O-)_nH$ m=1–4 and n=1–10, preferably 1–5.

Of these, the esters of 2-acrylamido-2-methylpropanesulphonic acid, styrenesulphonic acid, methallylsulphonic acid and 3-sulphopropyl-methacrylic acid ester may be mentioned as preferred.

The 4-hydroxybenzoic acid esters are preferably alkyl and aralkyl esters, in particular esters of $C_1$–$C_4$-alkanols and benzyl alcohol.

The amount added is 10–50% by weight, based on the acrylonitrile polymer employed.

Dyestuff precursors which are to be used are the dyestuff-forming agents which can usually be employed for pressure-copying and thermocopying purposes, excluding those which can be converted into dyestuffs only by atmospheric oxidation. Suitable colour-forming agents are described, for example, in the following publications: US-A-3,193,404, US-A-3,489,800, DE-A-2,001,864, DE-A-2,363,453, GB-A-1,160,940, JP-A-53/9,127, JP-A-46/29,550, JP-A-43/2,119, JP-A-52/148,099, JP-A-48/3,695, JP-A-51/23,204 and JP-A-56/52,729.

Examples of such compounds are carbinol bases and carbinol base derivatives of diaryl- and triarylmethane dyestuffs which are described, for example, in De-A-2,750,283, and fluorans.

To prepare the heat-sensitive materials, for example paper, the acid-modified acrylonitrile polymers are ground together with a 4-hydroxybenzoic acid ester and a binder, for example polyvinyl alcohol, hydroxyethyl-cellulose, gum arabic, polyvinylpyrrolidone or casein.

The polymer and the 4-hydroxybenzoic acid ester can also be ground separately and the dispersions can be mixed later.

For better formation of the dyestuff, it is advantageous to add fatty acids or fatty acid amides, long-chain alkylsulphates or esters of long-chain alcohols, for example phosphoric acid esters of $C_8$- to $C_{22}$-alcohols, to the polymers in amounts of 0.1 to 10%, based on the polymer. The polymer can also be treated beforehand, for example ground, with the additives. The colour donors are ground separately with the binders. The dispersions of the acceptor are mixed with the dispersions of the colour donor and the mixture is applied to the carrier material, preferably cellulose paper, with a doctor blade and dried in such a manner that an application weight of 5 to 8 g per $m^2$ results. Depending on the reactivity of the colour donor, it is also possible to grind the polymer and colour donor together with the binder and to apply the mixture as described. Bases, for example aliphatic amines or carbonates, for example whiting, can also be added to stabilize the colour-forming agent.

In another procedure, it is also possible to produce the acceptor paper from a mixture of an acrylonitrile polymer with a 4-hydroxybenzoic acid ester and the additives described above with pulp, sizing agent and aluminium sulphate in a sheet-forming machine and to coat the paper with the colour-forming agent.

The percentage data given in the examples are percentages by weight.

EXAMPLE 1

40 g of a finely powdered polyacrylonitrile polymer, prepared from 94% of acrylonitrile, 0.5% of methallylsulphonic acid and 5.5% of methyl acrylate, are ground with 19 g of benzyl 4-hydroxybenzoate and 225 g of a 2% strength aqueous polyvinyl alcohol solution, with the addition of 1.3 g of distearyl phosphate, in a bead mill. A second dispersion is prepared from 2 g of a colour-forming agent of the formula

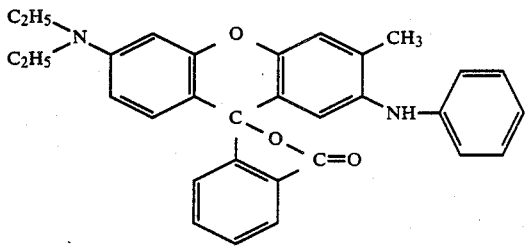

and 55 g of an 8% strength aqueous polyvinyl alcohol solution. The dispersion of the colour-forming agent is mixed with that of the developer in a ration of 1/10, 2 parts of a 50% strength aqueous whiting dispersion are added and the mixture is applied to cellulose paper by means of a doctor blade and dried in such a manner that an application weight of 6–7 g/$m^2$ is obtained. A heated pen gives, on a sheet of paper, black writing with very good fastness properties, in particular good fastness to plasticizer.

If a compound of the formula

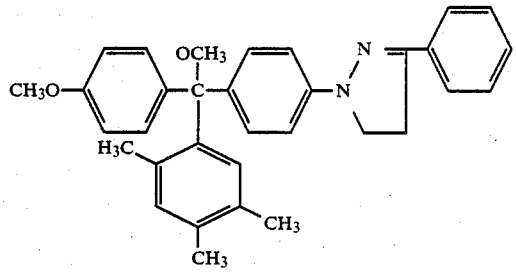

is used instead of the colour-forming agent mentioned above, contact with a heated pen gives fast black-blue writing.

EXAMPLE 2

40 g of an acrylonitrile polymer prepared from 67.5% of acrylonitrile, 23.8% of butyl acrylate, 3.8% of acrylic acid and 4.7% of 2-acrylamido-2-methylpropane-sulphonic acid which have been esterified with 2–3 mol of propylene oxide, are dispersed with 14 g of benzyl 4-hydroxybenzoate and 2 g of ethyl 4-hydroxybenzoate and 1.3 g of the ethanol-amine salt of distearyl phosphate are dispersed with 225 g of a 2% strength polyvinyl alcohol solution according to Example 1. The dispersion is mixed with a second dispersion of 2 g of the colour-forming agent of the formula

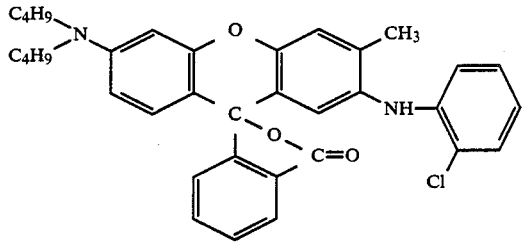

and 55 g of an aqueous 8% strength polyvinyl alcohol solution in a ratio of 1/10, 2 parts of a 50% strength whiting dispersion are added and the mixture is applied to paper in accordance with Example 1. When a hot pen is used to write on the paper, black fast writing is obtained.

EXAMPLE 3

40 g of a polyacrylonitrile polymer, prepared from 73% of acrylonitrile, 22% of butyl acrylate, 3% of methacrylic acid and 2% of 2-acrylamido-2-methylpropane-sulphonic acid, which has been esterified with 2–3 mol of propylene oxide are dispersed with 13 g of benzyl 4-hydroxybenzoate in a polyvinyl alcohol solution in accordance with Example 1. The dispersion is mixed with a second dispersion which contains 2 g of the colour donor of the formula

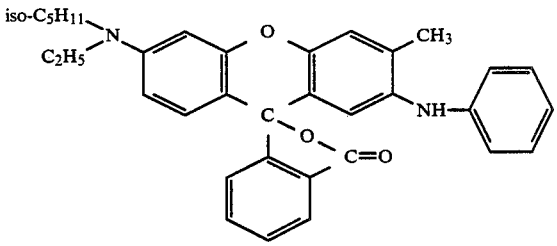

and the mixture is applied to paper, with the addition of whiting. When the paper is written on with a hot pen, fast black writing is obtained.

EXAMPLE 4

Preparation of an acid-modified poly(acrylonitrile-cobutyl acrylate)

Solutions used:

| | |
|---|---|
| Solution I | |
| Water | 420 g |
| 1 N $H_2SO_4$ | 5.60 g |
| $^R$Texapon K 12 | 0.23 g |
| Solution II | |
| Acrylonitrile | 22.50 g |
| Butyl acrylate | 7.50 g |
| Acrylic acid | 3.37 g |
| Ester* | 4.15 g |
| Solution III | |
| Demineralized water | 582 g |
| Na disulphite | 9.26 g |
| Solution IV | |
| Demineralized water | 574.50 g |
| 1 N $H_2SO_4$ | 5.60 g |
| Calgon solution (1% strength) | 1.90 g |
| K/Al sulphate × 12 $H_2O$ | 1.13 g |
| Na persulphate | 1.53 g |
| Solution V | |
| Acrylonitrile | 315 g |
| Butyl acrylate | 105 g |
| Acrylic acid | 16.90 g |
| Ester* | 26.25 g |

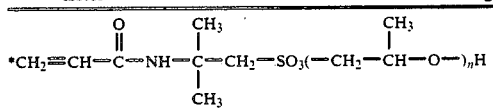

n = 1.5–2.5

Solution I and II are introduced into the reactor, while passing in nitrogen. After heating to a regulated temperature of 50° C., the polymerization is started by addition of 42 ml of solution III and 42 ml of solution IV. When the polymerization has started, the following solutions are metered in at the same time:

Solution III: 90 ml/hour

Solution IV: 90 ml/hour

Solution V: 87 ml/hour

After heating to a regulated temperature of 55–60° C., the polymer suspension is subjected to incipient distillation in vacuo under 150 mbar. 120 g of water and the majority of the volatile residual monomer constituents are removed in the course of 2 hours. The contents of the reactor are cooled, with stirring, and filtered in a centrifuge. The filter residue is washed with about 2.50 l of water.

Yield: 428 g (dry weight)

Conversion: 85.5%

K value: 79.5

Bulk density after drying: 0.26 g/cm

We claim:

1. A thermoreactive recording material which comprises a carrier material coated with a dyestuff precursor and, as an acceptor, an acid-modified polymer of acrylonitrile or methacrylonitrile and a benzyl 4-hydroxybenzoic acid ester.

2. Thermoreactive recording material according to claim 1, characterized in that the polymer has a total acid content of at least 50 m equivalents of acid groups/kg, of polymer.

3. A thermoreactive recording material according to claim 2, wherein the polymer contains at least 200 m equivalents of acid groups/kg of polymer wherein the polymer has a content of weakly acid groups of at least 20%.

4. Thermoreactive recording material according to claim 1, characterized in that the polymer contains at least 60 mol % of acrylonitrile units and, as acid groups, sulphonate or sulphate groups or ester groups derived from these and carboxyl groups.

5. Thermoreactive recording material according to claim 1, characterized in that the polymer has been prepared by polymeriazation of acrylonitrile and/or methacrylonitrile, acrylic acid esters, methacrylic acid esters and/or vinyl carboxylates, olefinically unsaturated carboxylic acids and comonomers containing sulphonic acid ester groups.

6. Thermoreactive recording material according to claim 1, characterized in that the weight content of the benzyl 4-hydroxybenzoic acid ester in the acceptor is 10–40%.

7. Thermoreactive recording material according to claim 1, characterized in that the recording material contains fluorans or carbinol bases or carbinol base derivatives of di- and triacrylmethane dyestuffs as the dyestuff precursors.

8. A process for the preparation of a thermoreactive recording material according to claim 1, comprising coating a carrier material with a formulation concerning a dyestuff precursor and an acceptor, said acceptor being an acid-modified polymer of acrylonitrile or methacrylonitrile and benzyl 4-hydroxybenzoic acid ester.

* * * * *

UNITED STATES PATENT AND TRADEMARK OFFICE

CERTIFICATE OF CORRECTION

PATENT NO. : 4,918,048

DATED : Apr. 17, 1990

INVENTOR(S) : Hubertus Psaar, et al.

It is certified that error appears in the above-identified patent and that said Letters Patent is hereby corrected as shown below:

Column 7, line 4 (claim 5, line 3), "polymeriazation" should read --polymerization--.

Column 7, line 13 (claim 6, line 4), "10-40%" should read --10 - 40%--.

Column 8, line 4 (claim 7, line 4), "triacaylmethane" should read --triarylmethane--.

Signed and Sealed this

Fifth Day of May, 1992

*Attest:*

DOUGLAS B. COMER

*Attesting Officer*

*Acting Commissioner of Patents and Trademarks*